US011011119B2

(12) United States Patent
Fan et al.

(10) Patent No.: US 11,011,119 B2
(45) Date of Patent: May 18, 2021

(54) ARRAY SUBSTRATES AND DISPLAY SCREENS

(71) Applicant: Kunshan Go-Visionox Opto-Electronics Co., Ltd., Kunshan (CN)

(72) Inventors: Longfei Fan, Kunshan (CN); Longyan Wang, Kunshan (CN); Zhanjie Ma, Kunshan (CN); Siming Hu, Kunshan (CN); Zhenzhen Han, Kunshan (CN); Hui Zhu, Kunshan (CN)

(73) Assignee: KUNSHAN GO-VISIONOX OPTO-ELECTRONICS CO., LTD., Kunshan (CN)

( * ) Notice: Subject to any disclaimer, the term of this patent is extended or adjusted under 35 U.S.C. 154(b) by 0 days.

(21) Appl. No.: 16/540,041

(22) Filed: Aug. 13, 2019

(65) Prior Publication Data

US 2019/0371251 A1 Dec. 5, 2019

Related U.S. Application Data

(63) Continuation of application No. PCT/CN2018/106317, filed on Sep. 18, 2018.

(30) Foreign Application Priority Data

May 14, 2018 (CN) ..... 201810454350.3

(51) Int. Cl.
*G09G 3/3291* (2016.01)
*G09G 3/3258* (2016.01)
(Continued)

(52) U.S. Cl.
CPC ..... *G09G 3/3291* (2013.01); *G09G 3/3258* (2013.01); *G09G 3/3266* (2013.01); *G09G 2310/0202* (2013.01)

(58) Field of Classification Search
CPC ..... G09G 3/20; G09G 3/3258; G09G 3/3266; G09G 3/3291
(Continued)

(56) References Cited

U.S. PATENT DOCUMENTS 7,411,354 B2 8/2008 Hsu et al.
10,692,438 B2 6/2020 Yang
(Continued)

FOREIGN PATENT DOCUMENTS

CN 104715719 A 6/2015
CN 103632633 B 8/2016
(Continued)

OTHER PUBLICATIONS

CN First Office Action dated Feb. 27, 2019 in the corresponding CN application (application No. 201810454350.3).
(Continued)

*Primary Examiner* — Kwin Xie
(74) *Attorney, Agent, or Firm* — Kilpatrick Townsend & Stockton

(57) ABSTRACT

The present disclosure relates to an array substrate and a display screen. The array substrate includes a first gate drive unit located in the non-display area and corresponding to pixels in the special-shaped display region, and a second gate driving unit located in the non-display area and corresponding to pixels in the non-special-shaped display region. A width-length ratio of a first output transistor of the first gate driving unit is smaller than a width-length ratio of a second output transistor of the second gate driving unit.

20 Claims, 9 Drawing Sheets

(51) Int. Cl.
*G09G 3/3266* (2016.01)
*G09G 3/20* (2006.01)

(58) Field of Classification Search
USPC ..... 345/76–84
See application file for complete search history.

(56) References Cited

U.S. PATENT DOCUMENTS

| | | | | |
|---|---|---|---|---|
| 2006/0261752 | A1 | 11/2006 | Lee | |
| 2010/0141570 | A1 | 6/2010 | Horiuchi et al. | |
| 2014/0055444 | A1 | 2/2014 | Jang et al. | |
| 2014/0078029 | A1 | 3/2014 | Jang | |
| 2015/0170612 | A1 | 6/2015 | Muguruma et al. | |
| 2016/0094224 | A1* | 3/2016 | Tamura | G11C 11/00 326/102 |
| 2017/0076667 | A1 | 3/2017 | Numata et al. | |
| 2017/0221423 | A1* | 8/2017 | Xiang | G09G 3/3233 |
| 2018/0129106 | A1 | 5/2018 | Gao et al. | |
| 2018/0166017 | A1* | 6/2018 | Li | G09G 3/3233 |
| 2018/0166018 | A1* | 6/2018 | Yang | G09G 3/3225 |
| 2018/0190946 | A1 | 7/2018 | Li et al. | |
| 2019/0228699 | A1* | 7/2019 | Gu | G09G 3/3275 |

FOREIGN PATENT DOCUMENTS

| | | | |
|---|---|---|---|
| CN | 106711180 | A | 5/2017 |
| CN | 103680397 | B | 8/2017 |
| CN | 107564452 | A | 1/2018 |
| CN | 107610636 | A | 1/2018 |
| CN | 107731153 | A | 2/2018 |
| CN | 107742499 | A | 2/2018 |
| CN | 107784939 | A | 3/2018 |
| CN | 107887418 | A | 4/2018 |
| CN | 108447439 | A | 8/2018 |
| CN | 108492775 | A | 9/2018 |
| CN | 208271541 | U | 12/2018 |
| CN | 107749247 | B | 9/2019 |
| JP | 2015087474 | A | 5/2015 |
| JP | 2017054058 | A | 3/2017 |
| WO | 2009054166 | A1 | 4/2009 |
| WO | 2018030207 | A1 | 2/2018 |

OTHER PUBLICATIONS

TW Office Action dated Jul. 19, 2019 in the corresponding TW application (application No. 107136875).
European Search Report of EP18919025.9 dated Aug. 17, 2020.
Office Actions of JP Patent Application No. 2020-501449.
Office Action of KR Patent Application No. 10-2020-7006739.

* cited by examiner

ARRAY SUBSTRATES AND DISPLAY SCREENS

CROSS-REFERENCES TO RELATED APPLICATIONS

This application is a continuation application of International Application PCT/CN2018/106317, filed on Sep. 18, 2018, which claims the priority benefit of Chinese Patent Application No. 201810454350.3, titled "ARRAY SUBSTRATE AND DISPLAY SCREEN" and filed on May 14, 2018. The entireties of both applications are incorporated by reference herein for all purposes.

TECHNICAL FIELD

The present disclosure relates to the field of display technologies.

BACKGROUND

At present, conventional display devices, such as display, television, mobile phone, tablet, etc., usually have a regular rectangular display screen. With the development of display technology, the rectangular display screen cannot meet diverse needs of users. Thus, the shape of the display screen is increasingly diverse.

A non-rectangular display screen is generally called a special-shaped display screen. The special-shaped display screen includes a special-shaped display region and a non-special-shaped display region. A number of pixels per line in the special-shaped display region is different from a number of pixels per line in the non-special-shaped display region.

SUMMARY

Accordingly, the present disclosure provides an array substrate and a display screen, which can solve the technical problem that the brightness of the display image is uneven due to the difference in the number of pixels on each row of the special-shaped display region and the non-special-shaped display region.

An array substrate is provided in the present disclosure, which includes: a substrate on which a display area and a non-display area are disposed, the display area includes pixels arranged in an array, and the display area includes a special-shaped display region and a non-special-shaped display region; at least one first gate driving unit located in the non-display area and connected to pixels on a corresponding row in the special-shaped display region via a first lead-out wire, the first gate driving unit is used to drive the pixels on the corresponding row; and at least one second gate driving unit located in the non-display area and connected to pixels on a corresponding row in the non-special-shaped display region via a second lead-out wire, the second gate driving unit is used to drive the pixels on the corresponding row. The first gate driving unit includes at least one first output transistor. The second gate driving unit includes at least one second output transistor, and a width-length ratio of the first output transistor is smaller than a width-length ratio of the second output transistor; and a width of the first lead-out wire corresponding to the special-shaped display region and a width of the second lead-out wire corresponding to the non-special-shaped display region are adaptively configured, respectively, to make the light emitting current of the special-shaped display region equal to the light emitting current of the non-special-shaped display region.

In an embodiment, a number of pixels on each row of the special-shaped display region is smaller than a number of pixels on any row of the non-special-shaped display region.

In an embodiment, the first gate driving unit includes a scan driving circuit and/or a emission driving circuit.

In an embodiment, the second gate driving unit includes a scan driving circuit and/or an emission driving circuit.

In an embodiment, the numbers of pixels on at least two rows in the special-shaped display region are different, and the width-length ratio of the first output transistor corresponding to pixels on each row in the special-shaped display region decreases as the number of pixels of the row decreases.

In an embodiment, the special-shaped display region includes at least one sub-special-shaped display region, and each sub-special-shaped display region includes pixels on at least two rows.

In an embodiment, the number of pixels on each row in the sub-special-shaped display region is the same, and the width-length ratio of the first output transistor corresponding to any row of pixels in the sub-special-shaped display region are equal.

In an embodiment, the width-length ratio of the first output transistor corresponding to pixels on each row in each sub-special-shaped display region is positively correlated with the number of pixels on each row in each sub-identical display region.

In an embodiment, a gate area of the first output transistor is greater than a gate area of the second output transistor.

In an embodiment, the special-shaped display region includes a plurality of sub-special-shaped display regions, each sub-special-shaped display region includes pixels on at least two rows, and the width-length ratio of the first output transistor corresponding to pixels on each row in different sub-special-shaped display regions is positively correlated with the number of pixels on each row of the different sub-special-shaped display regions.

In an embodiment, the array substrate further includes signal lines respectively located in the special-shaped display region and the non-special-shaped display region, the signal line in the special-shaped display region is attached to an edge of the special-shaped display region and concentrated in a concentrated winding routing layout. The signal line located in the special-shaped display region is used to connect the first output transistor, transmit a driving signal to the pixels on a corresponding row in the special-shaped display region, and compensate for difference in resistance between the resistance of the signal line in the special-shaped display region and the resistance of the signal line in the non-special-shaped display region.

In an embodiment, a width of the signal line of the special-shaped display region and a width of the signal line of the non-special-shaped display region are different.

In an embodiment, the signal line in the special-shaped display region includes a plurality segments of sub-signal lines, and a width of at least one of the plurality segments of sub-signal lines and a width of the signal line of the non-special-shaped display region are different.

In an embodiment, the signal line includes a scan signal line and a emission control signal line, the scan signal line is used to connect the scan driving circuit and corresponding pixels, and transmit a scan signal, the emission control signal line is used to connect the emission driving circuit and corresponding pixels, and the transmit a emission control signal.

In an embodiment, the array substrate is provided with a mounting groove in the non-display area, and the signal line of the special-shaped display region is attached to an edge of the mounting groove and in a concentrated winding routing layout.

In an embodiment, a dielectric constant of a gate insulating layer of the first output transistor is greater than a dielectric constant of a gate insulating layer of the second output transistor.

In an embodiment, a thickness of the gate insulating layer of the first output transistor is smaller than a thickness of the gate insulating layer of the second output transistor.

In an embodiment, a first mask layer is formed on a surface of the gate insulating layer of the first output transistor. The gate insulating layer of the first output transistor is exposed from the first mask layer, and the gate insulating layer of the first output transistor is micro-etched by using the first mask layer as a mask to make the thickness of the gate insulating layer of the first output transistor smaller than the thickness of the gate insulating layer of the second output transistor.

In an embodiment, the first output transistor has a semiconductor layer, a first gate insulating layer formed on the semiconductor layer, a second gate insulating layer formed on the first gate insulating layer, and a second mask layer formed on a surface of the second gate insulating layer. The second gate insulating layer of the first output transistor is exposed from the second mask layer, and the second gate insulating layer of the first output transistor is removed to expose the first gate insulating layer of the first output transistor by using the second mask layer as a mask, to make a sum of the thicknesses of the first gate insulating layer and the second gate insulating layer of the first output transistor smaller than the thickness of the gate insulating layer of the second output transistor.

A display screen is further provided in the present disclosure, which includes any one of the aforementioned array substrates.

The present disclosure provides an array substrate and a display screen. The corresponding display area on the array substrate includes a special-shaped display region and a non-special-shaped display region. A first gate driving unit located in the non-display area corresponds to the pixels in the special-shaped display region. A second gate driving unit located in the non-display area corresponds to the pixels in the non-special-shaped display region. The width-length ratio of the first output transistor of the first gate driving unit is smaller than the width-length ratio of the second output transistor of the second gate driving unit. The difference between the special-shaped display region and the non-special-shaped display region is accurately compensated by configuring the width of the first lead-out wire corresponding to the special-shaped display region and the width of the second lead-out wire corresponding to the non-special-shaped display region, to make the light emitting current of the special-shaped display region equal to the light emitting current of the non-special-shaped display region, which solves the technical problem that the brightness of the displayed image is uneven due to different loads between the special-shaped display area and the non-special-shaped display region, and improves the display effect.

DETAILED DESCRIPTION OF THE INVENTION

A driving circuit of a display panel controls pixels on a corresponding row through different scanning lines. However, when the scan line provides the same scan signal for the pixels on the corresponding row, since the number of pixels on each row of the special-shaped display region and the non-special-shaped display region is different, load on the scan line is different, which results in uneven brightness of a displayed image, and affects display effect.

The above objects, features and advantages of the present invention will become more apparent by describing in detail embodiments thereof with reference to the accompanying drawings. Numerous specific details are set forth in the description below to provide a thorough understanding of the present disclosure. However, the present disclosure can be implemented in many other ways than those described herein, and those skilled in the art can make similar modifications without departing from the scope of the present disclosure, and thus the present disclosure is not limited by the specific embodiments disclosed below.

Figure 1A:
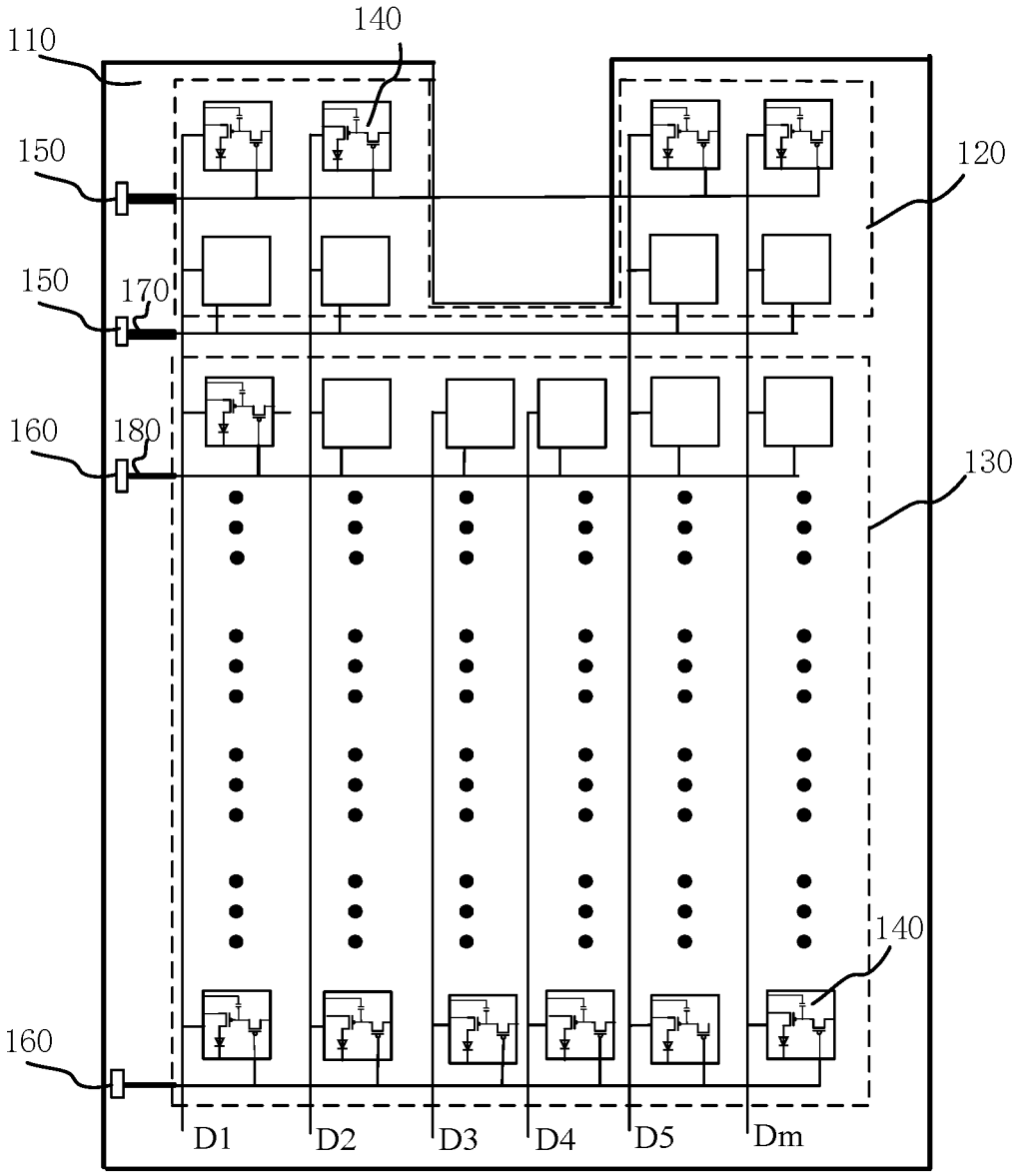
FIG. 1*a* is a schematic diagram of an array substrate in accordance with an embodiment of the present disclosure.

In an embodiment, referring to FIG. 1*a*, the present application provides an array substrate which includes a substrate. A display area and a non-display area 110 are disposed on the substrate. The display area includes a special-shaped display region 120 and a non-special-shaped display region 130. The corresponding display area on the substrate includes pixels 140 arranged in an array, and a number of pixels on each row of the special-shaped display region 120 is smaller than a number of pixels on any row of the non-special-shaped display region 130. When a driver drives the pixels on each row of the special-shaped display region and the pixels on each row of the non-special-shaped display region, since the numbers of pixels on each row of the special-shaped display region and the non-special-shaped display region are different, that is, loads are different, this may result in an uneven display of the special-shaped display region and the non-special-shaped display region.

The number of pixels on each row in the non-special-shaped display region is equal, and the non-special-shaped display region is generally a regular area. For example, the non-special-shaped display region has a rectangle shape. The numbers of pixels on each row of the non-special-shaped display region are generally equal, and luminescence characteristics of pixels on each row in the non-special-shaped display region remain the same.

Referring to FIG. 1*a*, the array substrate further includes at least one first gate driving unit 150 and at least one second gate driving unit 160. The first gate driving unit 150 is located in the non-display area 110. The first gate driving unit 150 connects the pixels 140 on a corresponding row in the special-shaped display region 120 via the first lead-out wire 170. The first gate driving unit 150 is used to drive the pixels 140 on the corresponding row. The second gate driving unit 160 is located in the non-display area 110. The second gate driving unit 160 connects the pixels 140 on a corresponding row in the non-special-shaped display region 130 via the second lead-out wire 180. The second gate driving unit 160 is used to drive the pixels 140 on the corresponding row. The first gate driving unit 150 includes at least one first output transistor, and the second gate driving unit 160 includes at least one second output transistor. The first output transistor and the second output transistor each include a gate, a source and a drain, and turn-off or turn-on of the first/second output transistor can be controlled by voltage of the gate. A width-length ratio of the first output transistor is smaller than a width-length ratio of the second output transistor. A width of the first lead-out wire 170 corresponding to the special-shaped display region 120 and a width of the second lead-out wire 180 corresponding to the non-special-shaped display region 130 are respectively adaptively configured, to make the light emitting current of the special-shaped display region equal to the light emitting current of the non-special-shaped display region. The width-length ratio of the transistor refers to a ratio of width to length of a conductive channel of the transistor, that is, W/L, wherein W is the width of the conductive channel of the transistor, and L is the length of the conductive channel of the transistor. In general, the larger the width-length ratio of a transistor, the greater the driving capability thereof, that is, the loading capability thereof, and the larger the driving current flowing through the transistor.

Figure 1B:
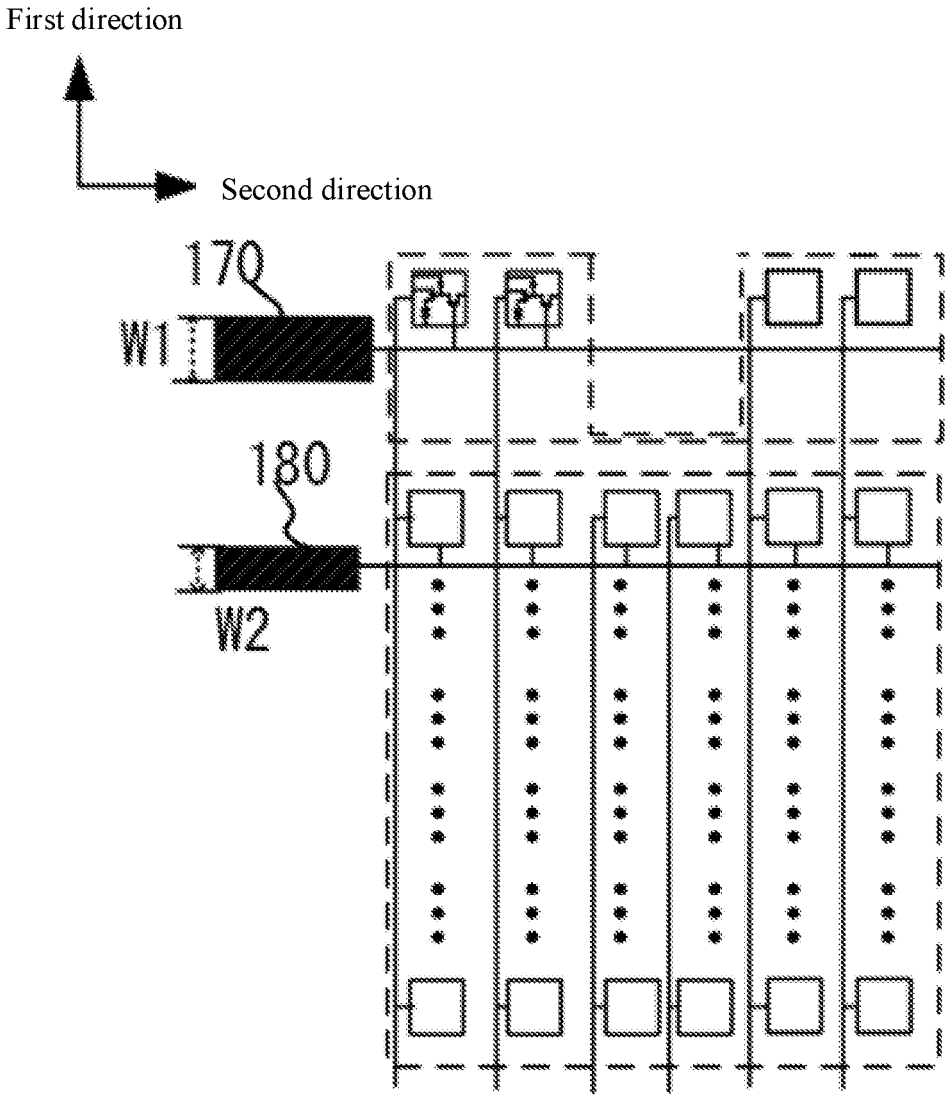
FIG. 1*b* is schematic diagram of a first lead-out wire and a second lead-out wire in accordance with an embodiment of the present disclosure.

Illustratively, referring to FIG. 1*b*, a scan signal line extends along a second direction. The first lead-out wire 170 is connected to the scan signal line of the special-shaped display region 120. The second lead-out wire 180 is connected to the scan signal line of the non-special-shaped display region 130. The width of the first lead-out wire 170 refers to a size W1 of the first lead-out wire 170 in a first direction, and the width of the second lead-out wire 180 refers to a size W2 of the second lead-out wire 180 in the first direction. The first direction and the second direction are perpendicular to each other. The scan signal line also has a certain size in the first direction, which is recorded as the width of the scan signal line. The scan signal line may include a plurality segments of sub-scan signal lines, and each sub-scan signal lines also has a certain size in the first direction, which is recorded as the width of the sub-scan signal line, and will not be described in detail herein.

Specifically, the difference between the special-shaped display region and the non-special-shaped display region cannot be accurately compensated by changing the width-length ratio of the first output transistor, and after reducing the width-length ratio of the first output transistor, the driving capability of the first gate driving unit 150 still cannot completely improve the problem of uneven display effect between the special-shaped display region 120 and the non-special-shaped display region 130. The width of the first lead-out wire 170 and the width of the second lead-out wire 180 can be further adaptively configured on the basis of changing the width-length ratio of the first output transistor, for example, by adaptively configuring, the width of the first lead-out wire 170 can be made to be equal to the width of the second lead-out wire 180, the width of the lead-out wire 170 can be made to be smaller than the width of the second lead-out wire 180, or the width of the first lead-out wire 170 can be made to be greater than the width of the second lead-out wire 180, to achieve precise compensation. Then, the driving capability of the first gate driving unit 150 in the special-shaped display region 120 can be reduced first by reducing the width-length ratio of the first output transistor in the special-shaped display region 120. Secondly, the width of the first lead-out wire 170 in the special-shaped display region 120 can be adaptively configured to vary capacitive load accordingly. In combination with two manners of reducing the width-length ratio of the first output transistor and adaptively adjusting the width of the first lead-out wire 170, the problem of uneven display effect between the special-shaped display region 120 and the non-special-shaped display region 130 can be solved from two aspects of the driving capability of the first gate driving unit 150 and the capacitive load.

For example, when the driving capability of the first gate driving unit 150 after the width-length ratio thereof being reduced is still relatively strong with respect to the number of pixels of the special-shaped display region 120, the width of the first lead-out wire 170 corresponding to the special-shaped display region can be increased, to make the width of the first lead-out wire 170 corresponding to the special-shaped display region greater than the width of the second lead-out wire 180 corresponding to the non-special-shaped display region to correspondingly increase the capacitive load of the special-shaped display region 120. When the driving capability of the first gate driving unit 150 after the width-length ratio being reduced is relatively weak with respect to the number of pixels of the special-shaped display region 120, the width of the first lead-out wire 170 corresponding to the special-shaped display region can be reduced, to make the width of the first lead-out wire 170 smaller than the width of the second lead-out wire 180 corresponding to the non-special-shaped display region to correspondingly reduce the capacitive load of the special-shaped display region 120.

Regarding to the manner of reducing the width-length ratio of the first output transistor only, simulation results are as shown in the following table. By reducing the width-length ratio of the first output transistor, the current difference between the special-shaped display region and the non-special-shaped display region is 0.27 nA. Before the width-length ratio of the first output transistor is changed, the current difference between the special-shaped display region and the non-profile display region is 5 nA, and the brightness of the special-shaped display region and the non-special-shaped display region differ by at least 5 gray scales. The uneven brightness between the special-shaped display region and the non-special-shaped display region is more obvious especially at a low gray scale.

| | Current before change (nA) | Changed current (nA) |
|---|---|---|
| Special-shaped display region | 181.84 | 177.49 |
| Non-special-shaped display region | 176.28 | 177.22 |

Regarding to the combination of the two manners of reducing the width-length ratio of the first output transistor and adaptively adjusting the width of the first lead-out wire 170, the simulation results are as shown in the following table, by reducing the width-length ratio of the first output transistor and adaptively adjusting the width of the first lead-out wire 170, the current difference between the special-shaped display region and the non-special-shaped display region is 0.08 nA. Therefore, the current difference after compensated in combination with the two manners is smaller than the current difference after compensated by one manner, such that the brightness between the special-shaped display region and the non-special-shaped display region can be made more uniform.

| | Current before change (nA) | Changed current (nA) |
|---|---|---|
| Special-shaped display region | 181.84 | 177.30 |
| Non-special-shaped display region | 176.28 | 177.22 |

In this embodiment, by reducing the width-length ratio of the first output transistor in the special-shaped display region and rationally configuring the width of the first lead-out wire 170 in the special-shaped display region, the driving capability of the first gate driving unit 150 in the special-shaped display region can be reduced and capacitor compensation can be appropriately performed, to make the light emitting current of the special-shaped display area equal to the light emitting current of the non-special-shaped display region, thereby solving the technical problem of the uneven brightness of the displayed image due to the load difference between the special-shaped display region and the non-special-shaped display region, and improving brightness uniformity between the special-shaped display region and the non-special-shaped display region.

In an embodiment, the first gate driving unit 150 and the second gate driving unit 160 are both gate driving units, and the gate driving unit includes a scan driving circuit and/or a emission driving circuit. The gate driving unit can only include the scan driving circuit, or can only include the emission driving circuit, and can include both of the scan driving circuit and the emission driving circuit. The scan driving circuit is used to sequentially apply scan signals to the pixels. The emission driving circuit is used to apply emission control signals to the pixels.

Figure 2:
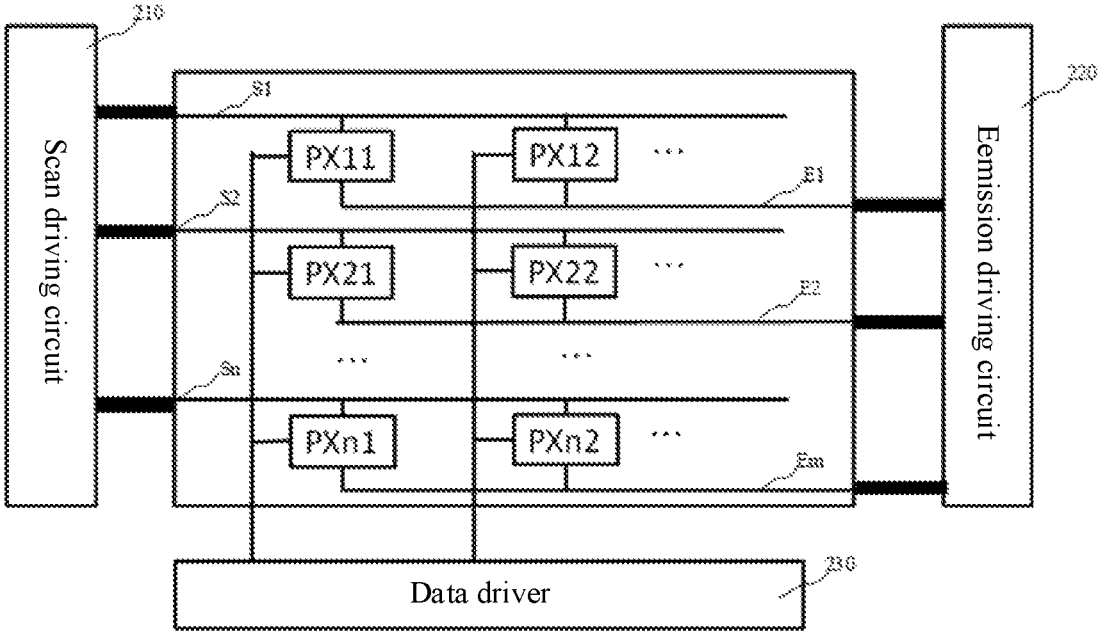
FIG. 2 is a schematic diagram of an array substrate in accordance with another embodiment of the present disclosure.

Illustratively, referring to FIG. 2, the gate driving unit includes a scan driving circuit 210 and an emission driving circuit 220. The scan driving circuit 210 is connected the plurality of pixels PX11 to PXnm arranged in a matrix via the scan signal lines S1 to Sn, and the pixels PX11 to PXnm are further connected to the emission control signal lines E1 to Em, and are connected to the emission driving circuit via the emission control signal lines E1 to Em. The emission control signal lines E1 to Em are substantially parallel to the scan signal lines S1 to Sn.

Figure 3:
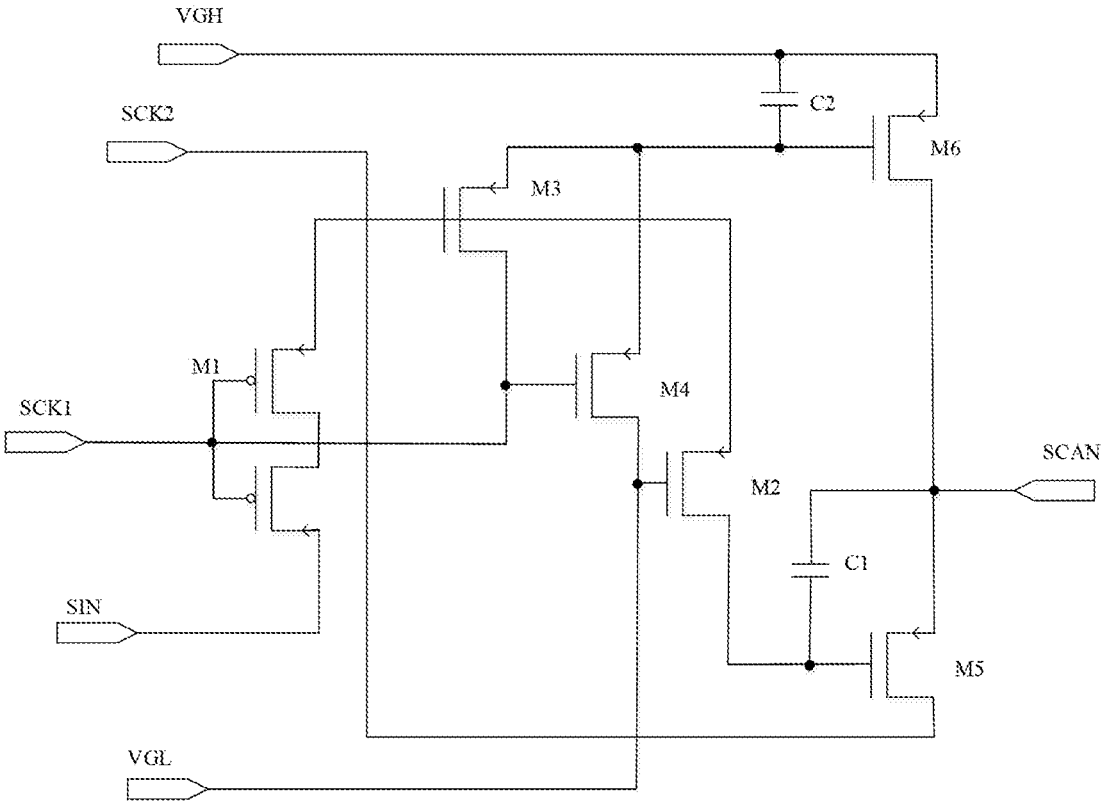
FIG. 3 is a circuit diagram of a 6T2C circuit in accordance with an embodiment of the present disclosure.

Illustratively, referring to FIG. 3, the scan driving circuit 210 is a 6T2C circuit, which includes a transistor M1, a transistor M2, a transistor M3, a transistor M4, a transistor M5, a transistor M6, a capacitor C1, and a capacitor C2. The transistor M5 and the transistor M6 are output transistors of the scan driving circuit 210. The transistor M5 and the transistor M6 are turned on or off according to the voltage of gates thereof. When the transistor M5 is turned on, an input signal of a clock signal input terminal SCK2 is transmitted to an output terminal of the scan driving circuit 210. When the transistor M6 is turned on, an input signal of a power supply voltage signal input terminal VGH is transmitted to the output terminal of the scan driving circuit 210. Furthermore, referring to FIG. 1*a* and FIG. 3, the width-length ratio of the first output transistor corresponding to the pixels of the special-shaped display region 120 is smaller than the width-length ratio of the second output transistor corresponding to the pixels of the non-special-shaped display region 130. Specifically, the width-length ratio of the transistor M5 corresponding to the pixels of the special-shaped display region 120 is smaller than the width-length ratio of the transistor M5 corresponding to the pixels of the non-special-shaped display region 130. The width-length ratio of the transistor M6 corresponding to the pixels of the special-shaped display region 120 is smaller than the width-length ratio of the transistor M6 corresponding to the pixels of the non-special-shaped display region 130.

Figure 4:
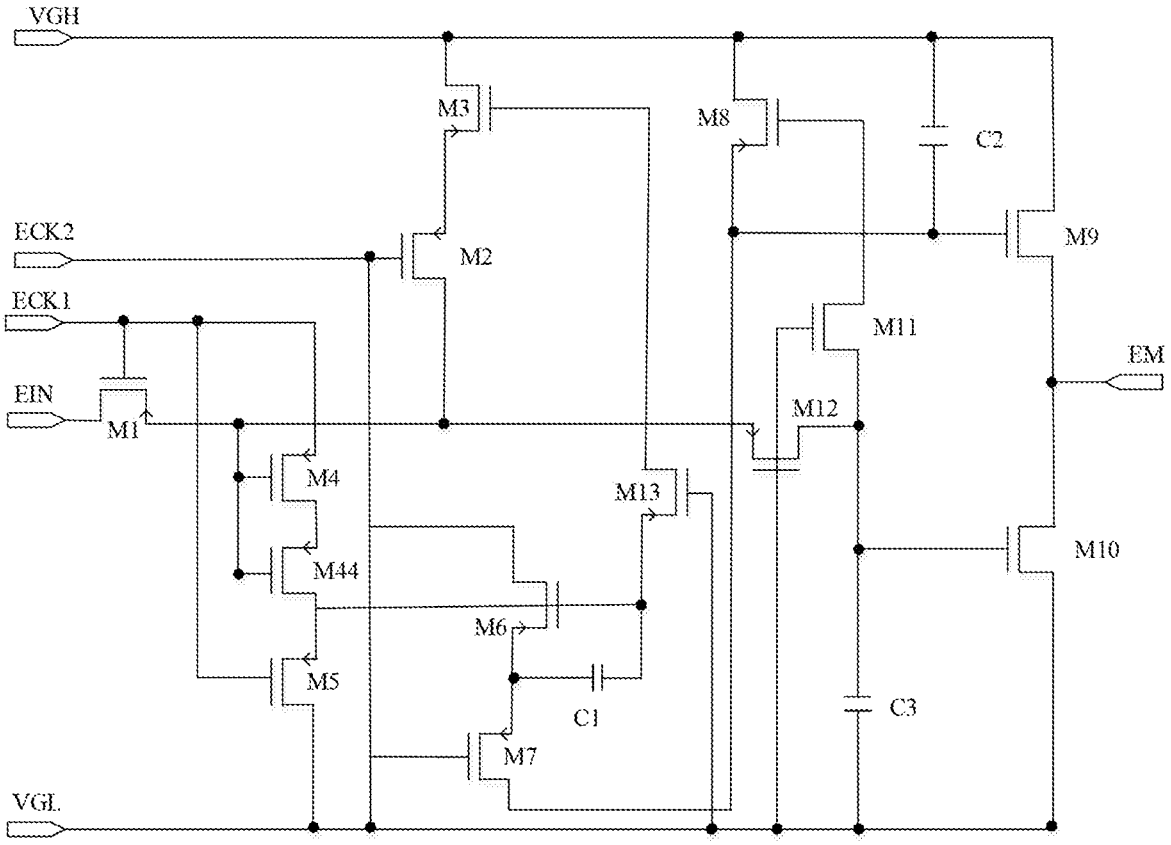
FIG. 4 is a circuit diagram of a 13T3C pixel circuit in accordance with an embodiment of the present disclosure.

Illustratively, referring to FIG. 4, the emission driving circuit 220 is a 13T3C circuit, which includes a transistor M1, a transistor M2, a transistor M3, a transistor M4, a transistor M5, a transistor M6, a transistor M7, a transistor M8, a transistor M9, a transistor M10, and a transistor M11, transistor M12, transistor M13, a capacitor C1, a capacitor C2, and a capacitor C3. The transistor M9 and the transistor M10 are output transistors of the emission driving circuit 220. The transistor M9 and the transistor M10 are turned on or off according to the voltage of gates thereof. When the transistor M9 is turned on, the input signal of the power supply voltage signal input terminal VGH is transmitted to the output end of the emission driving circuit 220, and when the transistor M10 is turned on, an input signal of a power supply voltage signal input terminal VGL is transmitted to an output terminal of the emission driving circuit 220. Furthermore, referring to FIG. 1*a* and FIG. 4, the width-length ratio of the first output transistor corresponding to the pixels of the special-shaped display region 120 is smaller than the width-length ratio of the second output transistor corresponding to the pixels of the non-special-shaped display region 130. Specifically, the width-length ratio of the transistor M9 corresponding to the pixels of the special-shaped display region 120 is smaller than the width-length ratio of the transistor M9 corresponding to the pixels of the non-special-shaped display region 130. The width-length ratio of the transistor M10 corresponding to the pixels of the special-shaped display region 120 is smaller than the width-length ratio of the transistor M10 corresponding to the pixels of the non-special-shaped display region 130.

Illustratively, referring to FIG. 1*a*, FIG. 2, FIG. 3, and FIG. 4, the gate driving unit in the array substrate includes a driving circuit 210 and the emission driving circuit 220, and can change the width-length ratio of the first output transistor corresponding to any one or both of the scan driving circuit 210 and the emission driving circuit 220, for example, can only reduce the width-length ratio of the transistor M5 and the transistor M6 in the scan driving circuit 210, can only reduce the width-length ratio of the transistor M9 and the transistor M10 in the emission driving circuit 220, or can simultaneously reduce the width-length ratio of the transistor M5 and the transistor M6 in the scan driving circuit 210 and the width-length ratio of the transistor M9 and the transistor M10 in the emission driving circuit 220.

The gate driving unit can include one of the scan driving circuit and the emission driving circuit, or include both the scan driving circuit and the emission driving circuit. For example, the gate driving unit can only include the scan driving circuit, and can include both of the scan driving circuit and the light emitting driving circuit. The designer can differently design the width-length ratio parameter of the first output transistor corresponding to the special-shaped display region and the second output transistor corresponding to the non-special-shaped display region according to actual conditions.

In this embodiment, by reducing the width-length ratio of first output transistor corresponding to any one or both of the scan output circuit and the emission driving circuit or the width-length ratio of first output transistor corresponding to both of the scan output circuit and the emission driving circuit, the driving capability of any one or both of the scan driving circuit or the emission driving circuit are reduced, which solves the problem of unbalanced load between the special-shaped display region and the non-special-shaped display region, so that the display effect of the special-shaped display region and the non-special-shaped display region is uniform, and the display effect is improved.

In an embodiment, the numbers of pixels on at least two rows of the special-shaped display region are different, and the width-length ratio of the first output transistor corresponding to pixels on each row decreases as the number of pixels in the row decreases. The special-shaped display region has a plurality of rows of pixels, and the numbers of pixels on at least two rows is different. When the number of pixels on each row of the special-shaped display region decreases, in order to make the display effect of the special-shaped display region and the non-special-shaped display region consistent, the driving capability of the gate driving unit corresponding to the special-shaped display region should be weakened, so that the width-length ratio of the first output transistor corresponding to pixels on each row in the special-shaped display region decreases as the number of pixels in the row decreases. Typically, the driver drives the pixels of the display area row by row. However, depending on the actual situation, the driver can drive the pixels of the display area column by column. When the driver drives the pixels on each column of the special-shaped display region, the load of the driver is related to the number of pixels on each column of the special-shaped display region. When the number of pixels on each column of the special-shaped display region decreases, the width-length ratio of the first output transistor corresponding to the special-shaped display region can decrease in the column direction. In this embodiment, the first output transistors of different width-length ratios can be accurately designed according to the number of pixels on each row in the special-shaped display region to solve the technical problem of uneven display effect of the special-shaped display region and the non-special-shaped display region.

In an embodiment, the special-shaped display region includes at least one sub-special-shaped display region, each sub-special-shaped display region includes pixels on at least two rows, and the numbers of the pixels on each row are the same. The width-length ratio of the first output transistors in each sub-special-shaped display area are equal.

Figure 5:
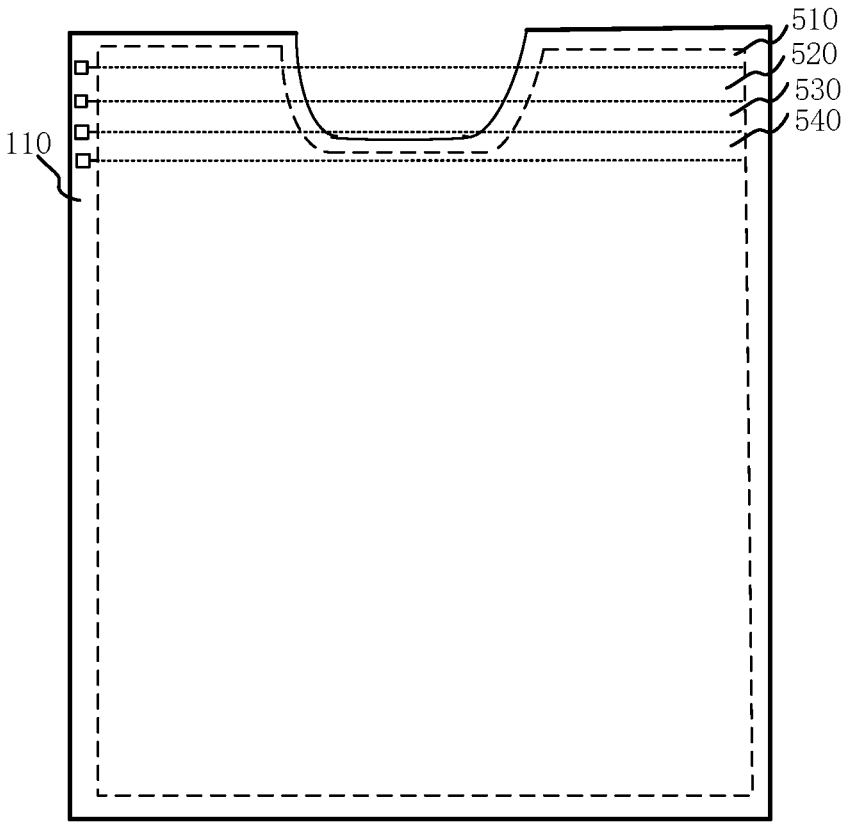
FIG. 5 is a schematic diagram of a plurality of sub-special-shaped display regions in accordance with an embodiment of the present disclosure.

The special-shaped display region can include one sub-special-shaped display region, and the special-shaped display region can also include a plurality of sub-special-shaped display regions, each sub-special-shaped display region includes pixels on at least two rows, and each row has the same number of pixels. Referring to FIG. 5, the special-shaped display region includes a first sub-special-shaped display region 510, a second sub-special-shaped display region 520, a third sub-special-shaped display region 530, and a fourth sub-special-shaped display region 540. The first sub-special-shaped display region 510 is taken as an example for description. The first sub-special-shaped display region 510 includes pixels on at least two rows, and the numbers of pixels on each row corresponding to the first sub-special-shaped display region 510 are approximately equal, then the width-length ratio of the first output transistor of the first sub-special-shaped display region 510 are substantially equal, and the width-length ratios of the first output transistors corresponding to any row of the pixels in the first sub-special-shaped display region 510 are equal. For the same reason, the width-length ratio of the first output transistor of the second sub-special-shaped display region 520, the third sub-special-shaped display region 530, and the fourth sub-special-shaped display region 540 can be known, and the details are not described herein again.

Furthermore, the number of pixels on each row of different sub-special-shaped display regions can be different. The width-length ratio of the first output transistor corresponding to pixels on each row in the different sub-special-shaped display regions is positively correlated with the number of pixels on each row of the different sub-special-shaped display regions. For example, the number of pixels on each row of the first sub-special-shaped display region 510 is smaller than the number of pixels on each row of the third sub-special-shaped display region 530, then the width-length ratio of the first output transistor corresponding to the first sub-special-shaped display region 510 is smaller than the width-length ratio of the first output transistor corresponding to the three sub-special-shaped display region 530.

Specifically, the number of pixels on each row in each sub-special-shaped display region can be equal or different. The width-length ratio of the first output transistor corresponding to pixels on each row with different numbers of pixels in each sub-special-shaped display region are also different, and the width-length ratio of the first output transistor corresponding to pixels on each row and the number of pixels on each row of each sub-special-shaped display regions is positively correlated, that is, the width-length ratio of the first output transistor decreases as the number of pixels on each row of each sub-special-shaped display region decreases, and increases as the number of pixels on each row of each sub-special-shaped display region increases.

In this embodiment, the special-shaped display region is divided into different sub-special-shaped display regions, the numbers of pixels on each row of the sub-special-shaped display region are regarded as approximately equal, the first output transistor is designed with respect to the sub-special-shaped display region, and the first output transistors corresponding to pixels on each row have the same width-length ratio, so that layout of the array substrate can be simple and the complexity of the process can be reduced.

In an embodiment, gate area of the first output transistor is greater than gate area of the second output transistor. The gate area of the transistor is equal to the product of gate length and gate width, which is approximately equal to the product of width and length of conductive channel of the transistor, i.e., W*L. In general, the larger the product of the width and length of the conductive channel of the transistor, the larger the parasitic capacitance of the transistor itself. Specifically, under the premise that the width-length ratio of the first output transistor is smaller than the width-length ratio of the second output transistor, the width and length of the first output transistor are approximately proportionally increased to keep the width-length ratio of the first output transistor unchanged, and the gate area of the first output transistor is simultaneously increased, then the gate area of the first output transistor is larger than the gate area of the second output transistor.

In this embodiment, under the premise that the width-length ratio of the first output transistor is smaller than the width-length ratio of the second output transistor, the gate length and gate width of the first transistor are approximately proportionally increased to keep the width-length ratio of the first output transistor unchanged, an overlapping area of the gate and channel layer of the first output transistor is increased, and the capacitive load is correspondingly increased, then the load reduction caused by the decrease in the number of pixels in the special-shaped display region is compensated, thereby solving the technical problem that the display is uneven due to the difference in the number of pixels per row of the special-shaped display region and the non-special-shaped display region.

In an embodiment, the array substrate further includes signal lines respectively located in the special-shaped display region and the non-special-shaped display region. The signal line in the special-shaped display region is attached to an edge of the special-shaped display region and in a concentrated winding routing layout. The signal line located in the special-shaped display region is used to connect the first output transistor, transmit driving signal to the pixels in the corresponding row in the special-shaped display region, and compensate for difference between resistance of the signal line in the special-shaped display region and resistance of the signal line in the non-special-shaped display region.

The signal line includes a scan signal line and a emission control signal line. The scan signal line is connected to the scan driving circuit and the corresponding pixels and transmits the scan signal, and the emission control signal line is connected to the emission driving circuit and the corresponding pixels, and transmits the emission control signal. The non-display area of the array substrate is provided with a mounting groove. An opening direction of the mounting groove can be in the row direction or in the column direction. The present disclosure does not limit the opening direction and specific position of the mounting groove. The mounting groove can be used to place sensors such as cameras, earpieces, fingerprint recognition components, iris recognition components, etc. The mounting groove results in creation of the special-shaped display region and less load in the special-shaped display region. In order to keep the brightness of the special-shaped display region and the non-special-shaped display region uniform, the gate area of the first output transistor is increased proportionally. However, the gate area of the first output transistor is larger than the gate area of the second output transistor, which causes gate line resistance of the first output transistor to decrease with respect to gate line resistance of the second output transistor. In this embodiment, in the special-shaped display region, the scan signal line which transmits the scanning signal is attached to the edge of the special-shaped display region and in a concentrated winding routing layout. The scan signal line located in the special-shaped display region increases the length of the scan signal line along the edge of the special-shaped display region, which correspondingly increases the resistance of the scan signal line of the special-shaped display region, thereby compensating for the difference in the resistance of the scan signal line of the special-shaped display region and the resistance of the scan signal line of the non-special-shaped display region.

Figure 7:
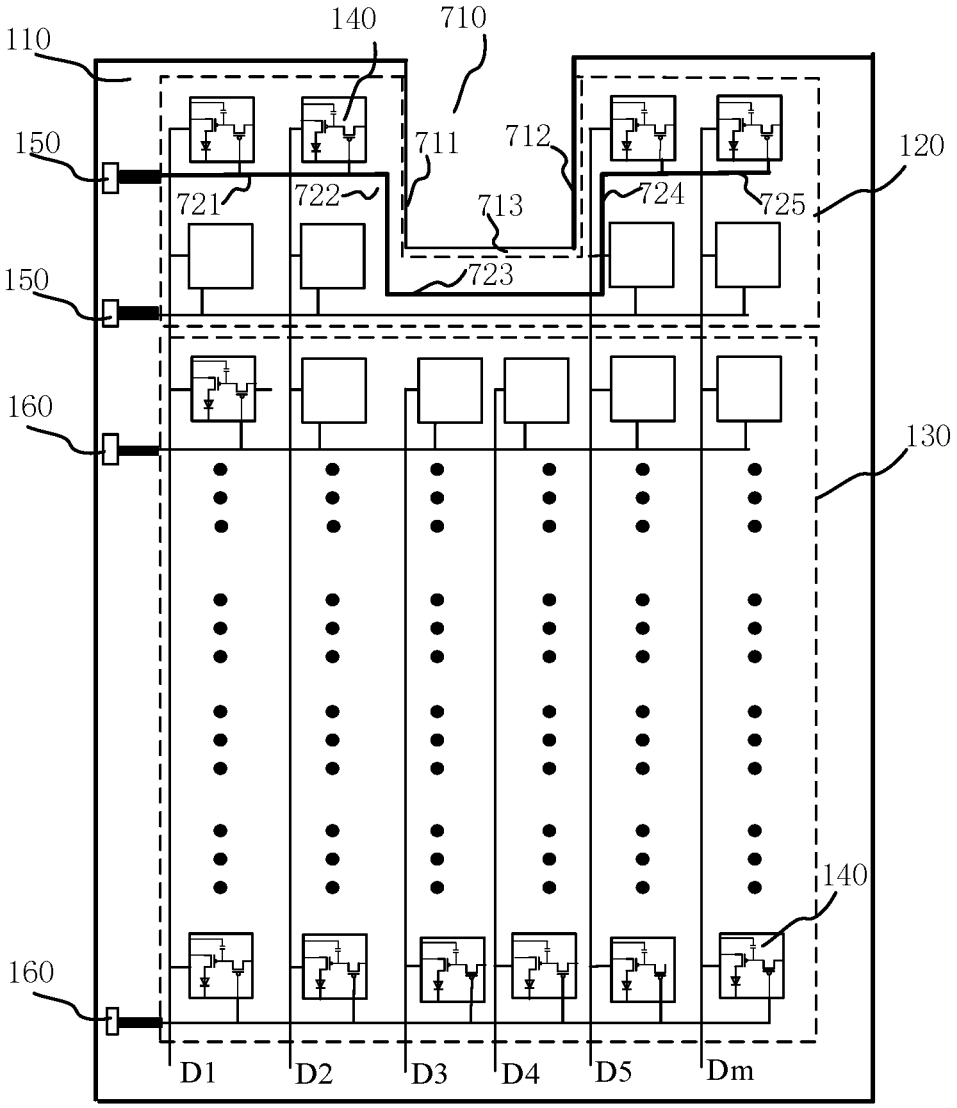
FIG. 7 is a schematic diagram of a scan signal line in the special-shaped display region in accordance with an embodiment of the present disclosure.

Specifically, the shape of the mounting groove can be U-shaped, curved, circular, etc. The mounting groove extends through the array substrate and includes a bottom surface and side surfaces on both sides of the bottom surface. A vertical projection area of the mounting groove on the array substrate is a grooved area, and the grooved area includes a bottom edge and side edges on both sides of the bottom edge. The bottom edge of the grooved area can extend along the row direction of pixel arrangement, and the bottom edge of the grooved area can also extend along the column direction of the pixel arrangement. For example, the scan signal line is taken as an example for description. Referring to FIG. 7, the mounting groove 710 is a U-shaped groove, and the mounting groove 710 is located in the non-display area. An area corresponding to the vertical projection of the mounting groove on the array substrate is a grooved area. The grooved area includes a bottom edge 713 and side edges 711 and side edges 712 distributed on both sides of the bottom edge 713. The scan signal lines corresponding to the special-shaped display region are routed along the bottom edge 713, the side edge 711, and the side edge 712. Specifically, the scan signal line in the special-shaped display region includes a first sub-scan signal line 721, a second sub-scan signal line 722 along the side edge 711, a third sub-scan signal line 723 along the bottom edge 713, a fourth sub-scan signal line 724 along the side edge 712, and a fifth sub-scan signal line 725.

Furthermore, the signal line of the special-shaped display region includes a plurality segments of sub-signal lines, and width of at least one of the plurality segments of sub-signal lines and the width of the signal line of the non-special-shaped display region are different. The width of the signal line is related to the resistance on the signal line. By changing the width of the signal line of the special-shaped display region, the resistance of the signal line can be changed correspondingly, thereby more accurately compensating for the difference in the resistance between the resistance on the signal line of the special-shaped display region and the resistance on the signal line of the non-special-shaped display region.

In this embodiment, the scan signal line is taken as an example for description. Referring to FIG. 7, the widths of the first sub-scan signal line 721 and the fifth sub-scan signal line 725 can be equal to the width of the gate of the first output transistor. Since the gate area of the first output transistor is large, the widths of the first sub-scan signal line 721 and the fifth sub-scan signal line 725 are large, which reduces the resistance on the scan signal line. However, the widths of the second sub-scan signal line 722, the third sub-scan signal line 723, and the fourth sub-scan signal line 724 can be adjusted to achieve accurate compensation of the resistance, for example, the widths of the second sub-scan signal line 722, the third sub-scan signal line 723, and the fourth sub-scan signal line 724 can be reduced to correspondingly increase the resistance on the scan signal line of the special-shaped display region. In addition, the width of partial section of the first sub-scan signal line 721 and the fifth sub-scan signal line 725 can be different from the width of the gate of the first output transistor, and the widths of the first sub-scan signal line 721, the second sub-scan signal line 722, the third sub-scan signal line 723, the fourth sub-scan signal line 724, and the fifth sub-scan signal line 725 can be adjusted, for example, the width of at least one of the first sub-scan signal line 721, the second sub-scan signal line 722, the third sub-scan signal line 723, the fourth sub-scan signal line 724, and the fifth sub-scan signal line 725 is reduced.

In this embodiment, the scan signal line in the special-shaped display region is routed along the edge of the mounting groove, which increases the length of the scan signal line in the special-shaped display region, and increases the resistance of the scan signal line, thereby solving the problem of unbalanced resistance caused by the small number of pixels in the special-shaped display area and achieving accurate compensation for the resistance in the special-shaped display area.

Figure 6:
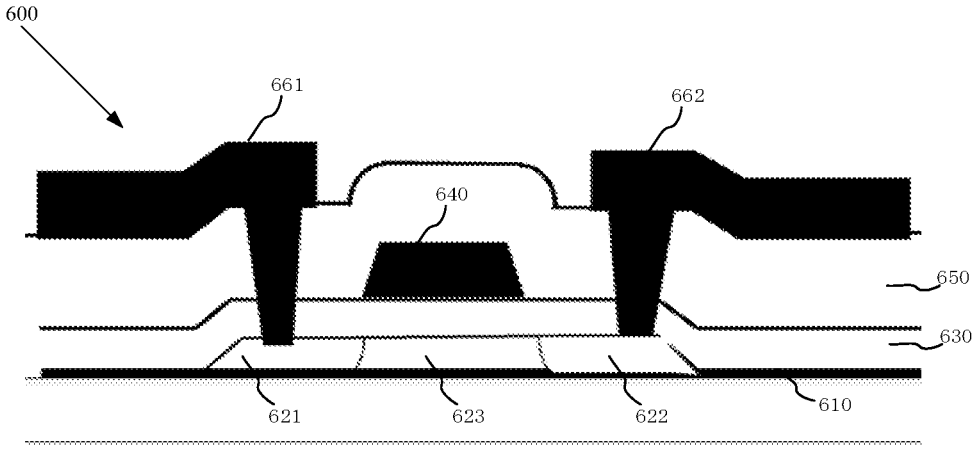
FIG. 6 is a schematic diagram of a first output transistor in accordance with an embodiment of the present disclosure.

In an embodiment, referring to FIG. 6, the first output transistor 600 includes a buffer layer 610, a semiconductor layer (not shown in figure) on the buffer layer 610, a gate insulating layer 630 on the semiconductor layer, and a gate 640 on a side of the gate insulating layer 630 away from the semiconductor layer, an inter-insulating layer 650 on the gate 640, and a source-drain metal layer (not shown in figure) on a side of the inter-insulating layer 650 away from the semiconductor layer. The semiconductor layer includes a source 621, a drain 622, and a channel 623. The source-drain metal layer includes a source metal lead-out wire 661 and a drain metal lead-out wire 662. Parasitic capacitance of the first output transistor 600 is related to thickness of the gate insulating layer and dielectric constant thereof, and the parasitic capacitance of the first output transistor 600 can be increased via the following two manners.

In the first manner, the dielectric constant of the gate insulating layer 630 of the first output transistor 600 can be changed to change the parasitic capacitance of the first output transistor 600. Specifically, the dielectric constant of the gate insulating layer of the first output transistor 600 can be made to be larger than the dielectric constant of the gate insulating layer of the second output transistor. Since the parasitic capacitance of the transistor is proportional to the dielectric constant of the transistor, and the dielectric constant of the gate insulating layer of the first output transistor 600 corresponding to the special-shaped display region can be made to be larger than the dielectric constant of the gate insulating layer of the second output transistor corresponding to the non-special-shaped display region by changing material of the gate insulating layer of the first driving transistor corresponding to the special-shaped display region.

In the second manner, the thickness of the gate insulating layer 630 corresponding to the special-shaped display region can be reduced to increase the parasitic capacitance of the first output transistor 600 corresponding to the special-shaped display region. Specifically, the thickness of the gate insulating layer of the first output transistor 600 can be made to be smaller than the thickness of the gate insulating layer of the second output transistor. When forming the gate insulating layer, the thickness of the gate insulating layer can be changed via the following two ways.

In the first one, a first mask layer is formed on a surface of the gate insulating layer, and the gate insulating layer of the special-shaped display region is exposed from the first mask layer. The gate insulating layer of the special-shaped display region is micro-etched with the first mask layer as a mask to reduce the thickness of the gate insulating layer of the special-shaped display region.

In the second one, a first gate insulating layer is formed on the semiconductor layer. A second gate insulating layer is formed on the first gate insulating layer. A second mask layer is formed on a surface of the second gate insulating layer. The second gate insulating layer of the special-shaped display region is exposed from the second mask layer. The second gate insulating layer of the special-shaped display region is removed with the second mask layer as a mask to expose the first gate insulating layer of the special-shaped display region, so that the thickness of the gate insulating layer corresponding to the special-shaped display region is made to be smaller than the thickness of the gate insulating layer corresponding to the non-special-shaped display region. In this embodiment, the designer needs to ensure the characteristics of the first output transistor and the second output transistor unchanged when increasing the dielectric constant of the gate insulating layer of the special-shaped display region or reducing the thickness of the gate insulating layer.

In an embodiment, a display screen is provided in the present disclosure, which includes the array substrate of any one of the afore-described embodiments. In an embodiment of the present disclosure the shape of the display screen can be a closed shape including at least one of a circle, an ellipse, a polygon, and a graphic including a circular arc. For example, it can be a display screen with an R angle, a groove, a notch, or a circle.

Figure 8:
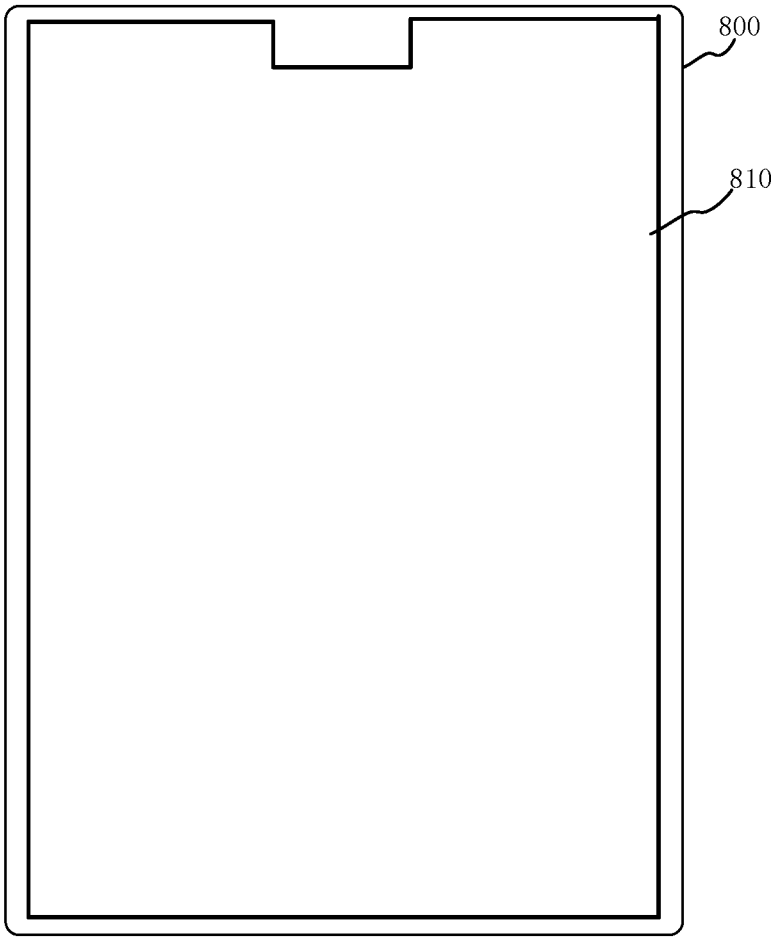
FIG. 8 is a schematic diagram of a display device in accordance with an embodiment of the present disclosure.

In an embodiment, a display device 800 is provided in the present disclosure. Referring to FIG. 8, the display device 800 includes the display screen 810 in the afore-mentioned embodiment.

The number of pixels in the special-shaped display region is different from the number of pixels distributed in the non-special-shaped display region. For example, the number of pixels on each row of the special-shaped display region is different from the number of pixels in each line of the non-special-shaped display region. The special-shaped display region and the non-special-shaped display region are relatively distinguished. In the present disclosure, a partial area with less pixels in the display area is referred to as the "special-shaped display region"; and a partial area with more pixels in the display area is referred to as the "non-special-shaped display region".

In addition, the terms "first", "second" and the like used in the embodiments of the present disclosure can be used herein to describe various elements, but these elements are not limited by these terms. These terms are only used to distinguish one element from another. For example, a first output transistor can be referred to as a second output transistor without departing from the scope of the present disclosure, and similarly, a second output transistor can be referred to as a first output transistor. Both the first output transistor and the second output transistor are output transistors, but they are not the same one output transistor.

The technical features of the above-described embodiments can be combined arbitrarily. For the sake of brevity of description, all possible combinations of the technical features in the above embodiments are not described. However, as long as there is no contradiction between the combinations of these technical features, all the combinations should be considered as the scope of this disclosure.

The above-mentioned embodiments are merely illustrative of several embodiments of the present disclosure, and the description thereof is more specific and detailed, but is not intended to limit the scope of the present disclosure. It should be noted that a number of variations and modifications can be made by those skilled in the art without departing from the spirit and scope of the present disclosure. Therefore, the scope of the present disclosure should be determined by the appended claims.

What is claimed is:

1. An array substrate, comprising:

a substrate having a display area and a non-display area, the display area comprising a plurality of pixels arranged in an array, and the display area comprising a special-shaped display region and a non-special-shaped display region;

a first gate driving unit, located in the non-display area and connected to the pixels on a corresponding row in the special-shaped display region via a first lead-out wire, and the first gate driving unit being configured to drive the pixels on the corresponding row; and a second gate driving unit, located in the non-display area and connected to pixels on a corresponding row in the non-special-shaped display region via a second lead-out wire, and the second gate driving unit being configured to drive the pixels on the corresponding row;

wherein the first gate driving unit comprises a first output transistor, the second gate driving unit comprises a second output transistor, a width-length ratio of the first output transistor being smaller than a width-length ratio of the second output transistor, and a width of the first lead-out wire corresponding to the special-shaped display region and a width of the second lead-out wire corresponding to the non-special-shaped display region are adaptively configured to respectively make the light emitting current of the special-shaped display region equal to the light emitting current of the non-special-shaped display region;

wherein the width-length ratio of the first output transistor is smaller than the width-length ratio of the second output transistor, and wherein an overlapping area of the gate and channel layer of the first output transistor is greater than a gate area of the second output transistor to balance the loads driven by the first output transistor and the second output transistor, respectively.

2. The array substrate according to claim 1, wherein a number of the pixels on each row of the special-shaped display region is smaller than a number of the pixels on any row of the non-special-shaped display region.

3. The array substrate according to claim 1, wherein the numbers of pixels on at least two rows in the special-shaped display region are different, and the width-length ratio of the first output transistor corresponding to pixels on each row in the special-shaped display region decreases as the number of pixels of the row decreases.

4. The array substrate according to claim 1, wherein the special-shaped display region comprises at least one sub-special-shaped display region, and each sub-special-shaped display region comprises at least two rows of pixels.

5. The array substrate according to claim 4, wherein the number of pixels on each row in the sub-special-shaped display region is the same, and the width-length ratio of the first output transistor corresponding to any row of pixels in the sub-special-shaped display region are equal.

6. The array substrate according to claim 4, wherein the width-length ratio of the first output transistor corresponding to pixels on each row in each sub-special-shaped display region is positively correlated with the number of pixels on each row in each sub-identical display region.

7. The array substrate according to claim 5, wherein the special-shaped display region comprises a plurality of sub-special-shaped display regions, each sub-special-shaped display region comprises at least two rows of pixels, and the width-length ratio of the first output transistor corresponding to pixels on each row in different sub-special-shaped display regions is positively correlated with the number of pixels on each row of the different sub-special-shaped display regions.

8. The array substrate according to claim 1, further comprising signal lines respectively located in the special-shaped display region and the non-special-shaped display region, the signal line in the special-shaped display region being attached to an edge of the special-shaped display region;

the signal line located in the special-shaped display region being configured to connect the first output transistor, transmit a driving signal to the pixels on a corresponding row in the special-shaped display region, and compensate for difference in resistance between the resistance of the signal line in the special-shaped display region and the resistance of the signal line in the non-special-shaped display region.

9. The array substrate according to claim 8, wherein a width of the signal line of the special-shaped display region is different from a width of the signal line of the non-special-shaped display region.

10. The array substrate according to claim 8, wherein the signal line in the special-shaped display region comprises a plurality segments of sub-signal lines, and a width of at least one of the plurality segments of sub-signal lines is different from a width of the signal line of the non-special-shaped display region.

11. The array substrate according to claim 8, wherein the signal line comprises a scan signal line and a emission control signal line, the scan signal line is configured to connect the scan driving circuit and corresponding pixels and transmit a scan signal, and the emission control signal line is configured to connect the emission driving circuit and corresponding pixels and transmit a emission control signal.

12. The array substrate according to claim 8, wherein the array substrate is provided with a mounting groove in the non-display area, and the signal line of the special-shaped display region is attached to an edge of the mounting groove;

wherein the mounting groove is U-shaped, and the mounting groove extends through the array substrate and includes a bottom edge and side edges on both sides of the bottom edge;

wherein a scan signal line corresponding to the special-shaped display region includes a first sub-scan signal line, a second sub-scan signal line along a first side edge, a third sub-scan signal line along the bottom edge, a fourth sub-scan signal line along a second side edge, and a fifth sub-scan signal line.

13. The array substrate according to claim 1, wherein a dielectric constant of a gate insulating layer of the first output transistor is larger than a dielectric constant of a gate insulating layer of the second output transistor.

14. The array substrate according to claim 1, wherein a thickness of the gate insulating layer of the first output transistor is smaller than a thickness of the gate insulating layer of the second output transistor.

15. The array substrate according to claim 14, wherein a first mask layer is formed on a surface of the gate insulating layer of the first output transistor, the gate insulating layer of the first output transistor is exposed from the first mask layer, and the gate insulating layer of the first output transistor is micro-etched by using the first mask layer as a mask to make the thickness of the gate insulating layer of the first output transistor smaller than the thickness of the gate insulating layer of the second output transistor.

16. The array substrate according to claim 14, wherein the first output transistor has a semiconductor layer, a first gate insulating layer formed on the semiconductor layer, a second gate insulating layer formed on the first gate insulating layer, and a second mask layer formed on a surface of the second gate insulating layer, the second gate insulating layer of the first output transistor is exposed from the second mask layer, and the second gate insulating layer of the first output transistor is removed to expose the first gate insulating layer of the first output transistor by using the second mask layer as a mask to make a sum of the thicknesses of the first gate insulating layer and the second gate insulating layer of the first output transistor smaller than the thickness of the gate insulating layer of the second output transistor.

17. A display screen, comprising the array substrate of claim 1.

18. The array substrate according to claim 8, wherein the array substrate is provided with a mounting groove in the non-display area, and the signal line of the special-shaped display region is attached to an edge of the mounting groove;

wherein the mounting groove is circular, and the mounting groove extends through the array substrate and includes a bottom edge and side edges on both sides of the bottom edge;

wherein a scan signal line corresponding to the special-shaped display region includes a first sub-scan signal line, a second sub-scan signal line along a first side edge, a third sub-scan signal line along the bottom edge, a fourth sub-scan signal line along a second side edge, and a fifth sub-scan signal line.

19. The array substrate according to claim 8, wherein the array substrate is provided with a mounting groove in the non-display area, and the signal line of the special-shaped display region is attached to an edge of the mounting groove;

wherein the mounting groove is curved, and the mounting groove extends through the array substrate and includes a bottom edge and side edges on both sides of the bottom edge;

wherein a scan signal line corresponding to the special-shaped display region includes a first sub-scan signal line, a second sub-scan signal line along a first side edge, a third sub-scan signal line along the bottom edge, a fourth sub-scan signal line along a second side edge, and a fifth sub-scan signal line.

20. The array substrate according to claim 19, wherein the widths of the first sub-scan signal line and the fifth sub-scan signal line is equal to the width of the gate of the first output transistor.

* * * * *